US010234089B2

(12) United States Patent
Prince

(10) Patent No.: US 10,234,089 B2
(45) Date of Patent: Mar. 19, 2019

(54) LANTERN ASSEMBLY AND AUXILIARY BASE

(71) Applicant: Gerry Duane Prince, Medicine Hat (CA)

(72) Inventor: Gerry Duane Prince, Medicine Hat (CA)

( * ) Notice: Subject to any disclaimer, the term of this patent is extended or adjusted under 35 U.S.C. 154(b) by 296 days.

(21) Appl. No.: 15/279,561

(22) Filed: Sep. 29, 2016

(65) Prior Publication Data

US 2017/0089531 A1 Mar. 30, 2017

Related U.S. Application Data

(60) Provisional application No. 62/234,055, filed on Sep. 29, 2015.

(51) Int. Cl.

| | |
|---|---|
| ***F21S 6/00*** | (2006.01) |
| ***F21V 7/00*** | (2006.01) |
| ***F21V 21/08*** | (2006.01) |
| ***F21V 35/00*** | (2006.01) |

(52) U.S. Cl.

CPC ..... *F21S 6/005* (2013.01); *F21V 7/00* (2013.01); *F21V 21/0832* (2013.01); *F21V 35/00* (2013.01)

(58) Field of Classification Search

CPC ..... F21V 21/04; F21V 17/005; F21V 17/14; F21V 7/00; F21V 21/0832; F21V 35/00; F21Y 2103/33; F21Y 2115/10; F21S 8/024; F21S 6/005; F21S 6/004; F21S 6/006; F21S 6/007; F21S 6/008

See application file for complete search history.

(56) References Cited

U.S. PATENT DOCUMENTS

| | | | | |
|---|---|---|---|---|
| 504,554 A * | 9/1893 | Burtner | ..... | F21V 37/00 431/324 |
| 611,397 A | 9/1898 | Steinenbohmer | | |
| 1,304,088 A | 5/1919 | Patterson | | |

(Continued)

FOREIGN PATENT DOCUMENTS

| | | |
|---|---|---|
| CA | 110569 A | 3/1908 |
| CA | 2223763 A1 | 6/1999 |

(Continued)

OTHER PUBLICATIONS http://ucogear.com/candle-lanterns/.
http://ucogear.com/pac-flat-reflector.html.

*Primary Examiner* — Anh T Mai
*Assistant Examiner* — Fatima N Farokhrooz
(74) *Attorney, Agent, or Firm* — Black, McCuskey, Souers & Arbaugh, LPA

(57) ABSTRACT

A lantern auxiliary base can include a wall, a floor, a first cross-beam, a second cross-beam, and a ring. The wall can encircle an axis and extend between a top end and a bottom end. The floor can be engaged with the wall and at least partially close the bottom end, defining a cup-shaped cavity. The floor can have top and bottom surfaces. The first and second cross-beams can project along the axis away from the bottom surface and be transverse to one another. At least one of the first and second cross-beams can extend a first distance from the bottom surface. The ring can project along the axis away from the bottom surface to a bottom edge a second distance from the bottom surface along the longitudinal axis less than the first distance.

20 Claims, 9 Drawing Sheets

(56) References Cited

U.S. PATENT DOCUMENTS

| | | | | | |
|---|---|---|---|---|---|
| 1,357,824 | A | * | 11/1920 | Rhodes | A61L 9/03 362/127 |
| 1,417,672 | A | * | 5/1922 | Lindemann | F21V 37/00 137/453 |
| 1,575,795 | A | * | 3/1926 | Sample | F21V 21/02 24/369 |
| 2,621,503 | A | * | 12/1952 | Schaefer | F21V 35/00 362/161 |
| 2,685,023 | A | | 7/1954 | Valle | |
| 2,914,185 | A | * | 11/1959 | Le Vay | A47G 33/00 211/181.1 |
| 4,134,718 | A | * | 1/1979 | Kayfetz | F21V 35/00 431/125 |
| 4,186,430 | A | | 1/1980 | Britton | |
| 4,260,365 | A | | 4/1981 | Kayne | |
| 4,566,055 | A | | 1/1986 | Klees et al. | |
| 4,646,213 | A | | 2/1987 | Fanelli et al. | |
| D288,722 | S | | 3/1987 | Harada | |
| 4,926,297 | A | | 5/1990 | Masters et al. | |
| D321,261 | S | | 10/1991 | Shiraishi | |
| 5,209,561 | A | | 5/1993 | Bond | |
| 5,424,928 | A | | 6/1995 | Jordan et al. | |
| 5,683,239 | A | | 11/1997 | Cardosi | |
| 5,688,040 | A | | 11/1997 | Klees | |
| 5,722,763 | A | | 3/1998 | Chen | |
| 5,775,530 | A | | 7/1998 | Attaway | |
| 5,803,587 | A | | 9/1998 | Chen | |
| D414,570 | S | | 9/1999 | Shin et al. | |
| 6,030,093 | A | | 2/2000 | Draper | |
| 6,270,341 | B1 | | 8/2001 | Garcia | |
| 6,685,337 | B2 | | 2/2004 | Klees | |
| D659,864 | S | | 5/2012 | Trittis | |
| 8,939,601 | B1 | | 1/2015 | Lee | |
| 2006/0268541 | A1 | | 11/2006 | Schou | |
| 2012/0077134 | A1 | | 3/2012 | Franklin | |
| 2012/0188776 | A1 | * | 7/2012 | Chen | F21L 4/005 362/396 |
| 2012/0230042 | A1 | | 9/2012 | Trittis et al. | |
| 2015/0167931 | A1 | * | 6/2015 | Borgarelli | F21V 7/00 362/297 |

FOREIGN PATENT DOCUMENTS

| | | | | |
|---|---|---|---|---|
| CA | 2247751 | A1 | | 3/2000 |
| CA | 2414451 | A1 | | 6/2004 |
| CA | 2772455 | A1 | | 9/2012 |
| EP | 2902699 | | * | 8/2015 |
| GB | 16310 | | | 11/1898 |
| GB | 15416 | | | 9/1904 |
| GB | 13138 | | | 4/1907 |
| GB | 147407 | A | | 7/1920 |
| GB | 2457545 | A | | 8/2009 |
| KR | 1020040075442 | A | | 8/2004 |

* cited by examiner

LANTERN ASSEMBLY AND AUXILIARY BASE

CROSS-REFERENCE TO RELATED APPLICATION

This application claims the benefit of U.S. Provisional Patent Application Ser. No. 62/234,055 for a LANTERN AUXILIARY BASE, filed on Sep. 29, 2015, which is hereby incorporated by reference in its entirety.

BACKGROUND

1. Field

The present disclosure relates to portable lanterns.

2. Description of Related Prior Art

U.S. Pat. No. 5,209,561 discloses FLAT-PACK CONICAL SHADE. The frusto-conical shade comprised of two semicircular, flat sheets made of a resilient material, each with at least one surface that reflects light. Each generally semicircular sheet has a semicircular cut-out that forms an opening in the top of the assembled reflector. Fasteners are located on either side of the cut-away semicircular portion; the fasteners on one sheet are disposed to releasably mate with the fasteners on the other sheet so that when the sheets are deflected and the fasteners on the one sheet are aligned with the fasteners on the second sheet, the two sheets together form a frusto-conical reflector.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A lantern auxiliary base can include a wall, a floor, a first cross-beam, a second cross-beam, and a ring. The wall can encircle a vertically-extending longitudinal axis and extend along the longitudinal axis between a top end and a bottom end. The floor can be fixedly engaged with the wall at the bottom end and can at least partially close the bottom end while the top end can remain open. The wall and the floor can define a cup-shaped cavity. The floor can have a top surface facing the top end and a bottom surface opposite the top surface. The first cross-beam can project along the longitudinal axis away from the bottom surface. The second cross-beam can project along the longitudinal axis away from the bottom surface. The first and second cross-beams can be transverse to one another. At least one of the first and second cross-beams can extend a first distance from the bottom surface along the longitudinal axis. The ring can project vertically downward along the longitudinal axis away from the bottom surface to a bottom edge. The bottom edge can be a second distance from the bottom surface along the longitudinal axis less than the first distance.

BRIEF DESCRIPTION OF THE DRAWINGS

The detailed description set forth below references the following drawings.

DETAILED DESCRIPTION

Figure 1:
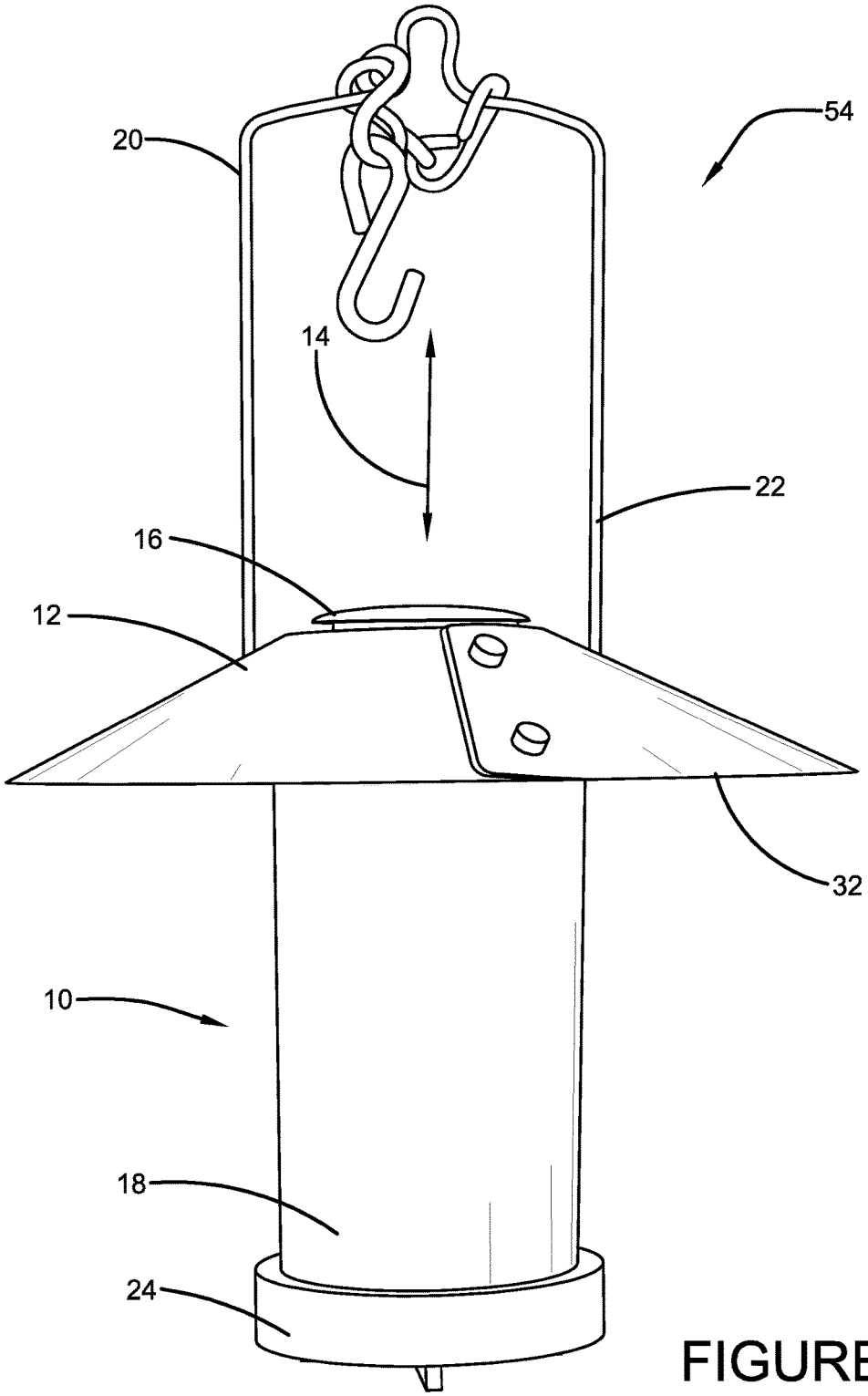
FIG. 1 is a perspective view of a portable lantern and a shade according to the prior art.
Figure 2:
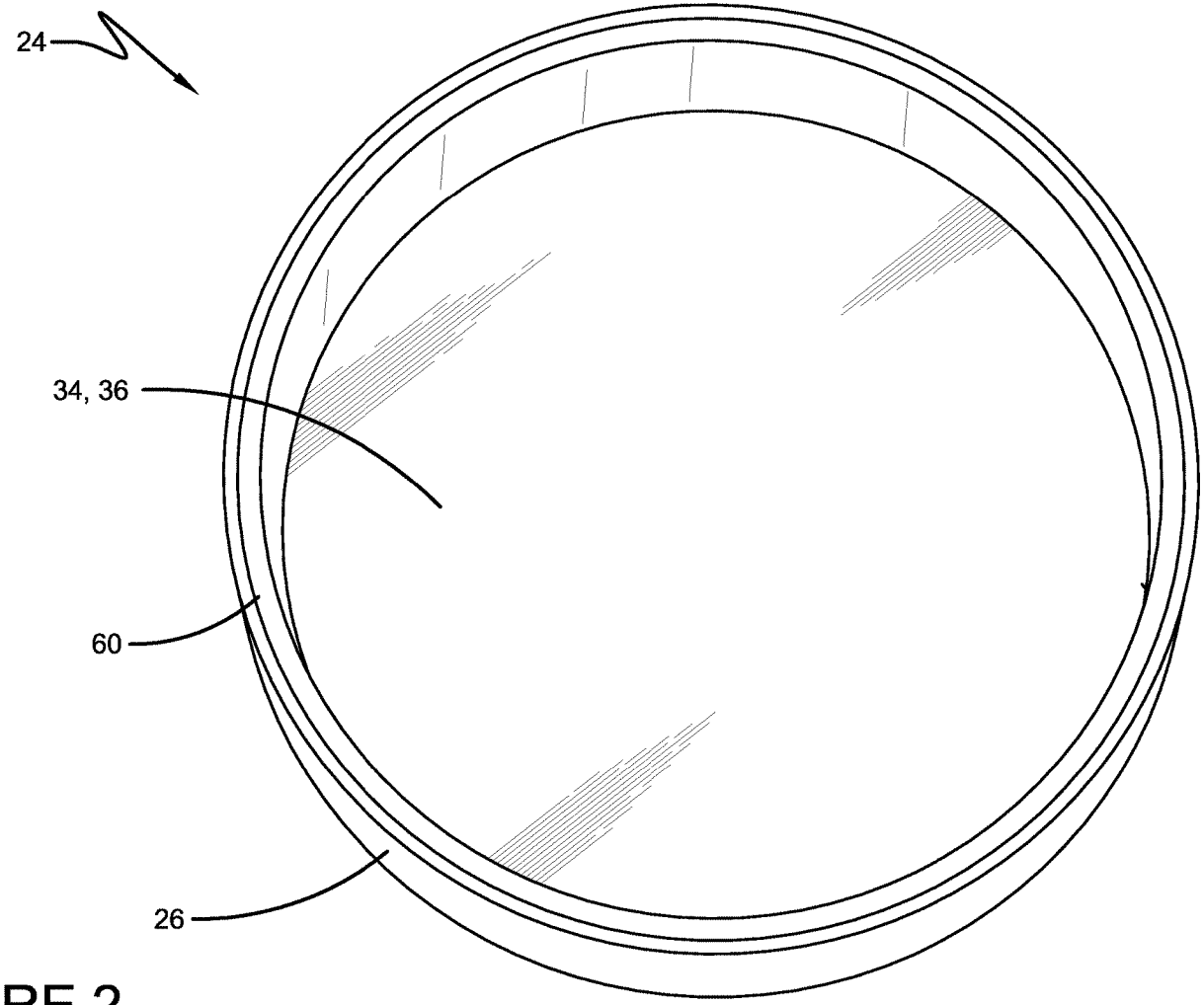
FIG. 2 is a generally top-down perspective view of a lantern auxiliary base according to an exemplary embodiment of the present disclosure.
Figure 3:
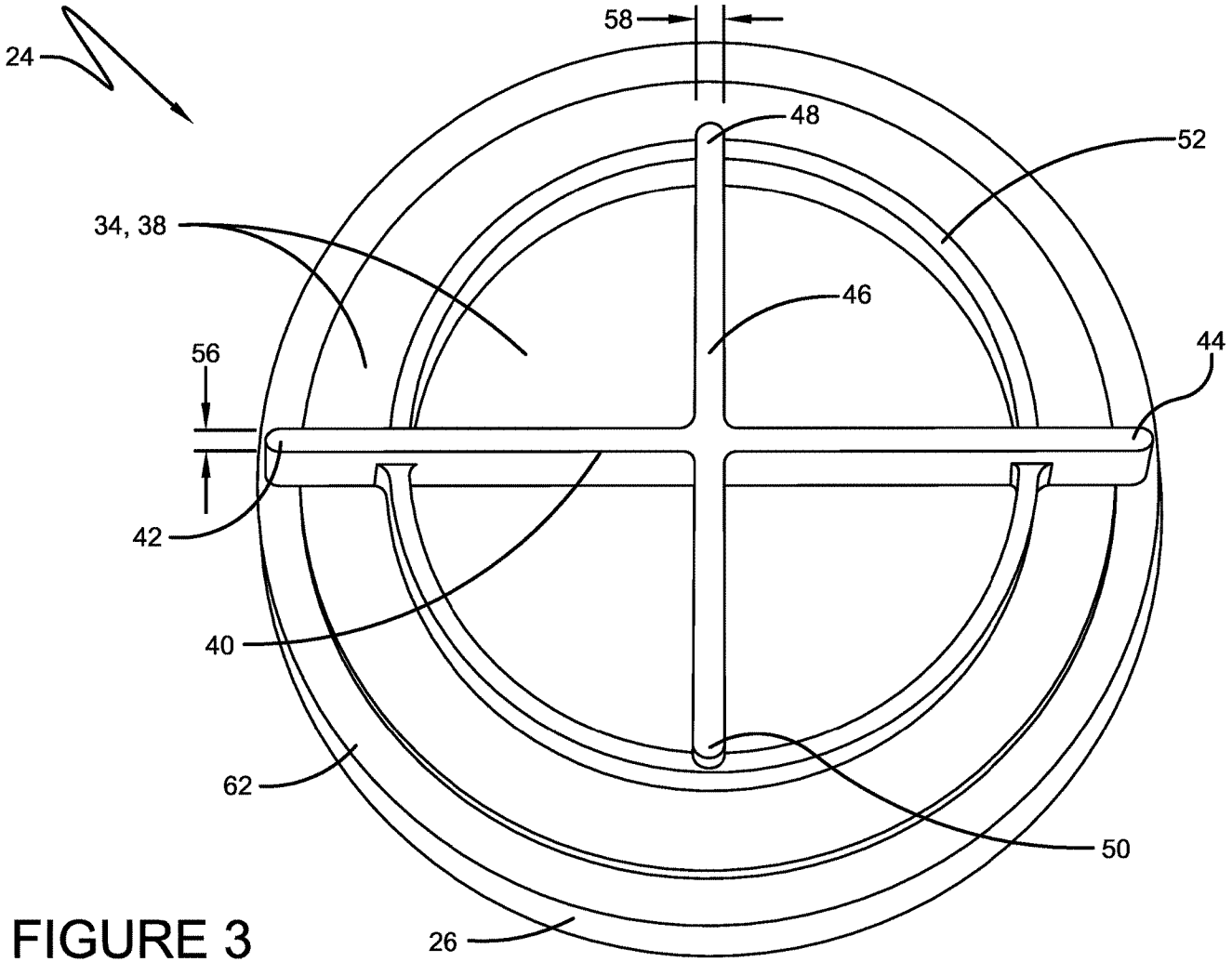
FIG. 3 is a generally bottom-up perspective view of the lantern auxiliary base shown in FIG. 2.
Figure 4:
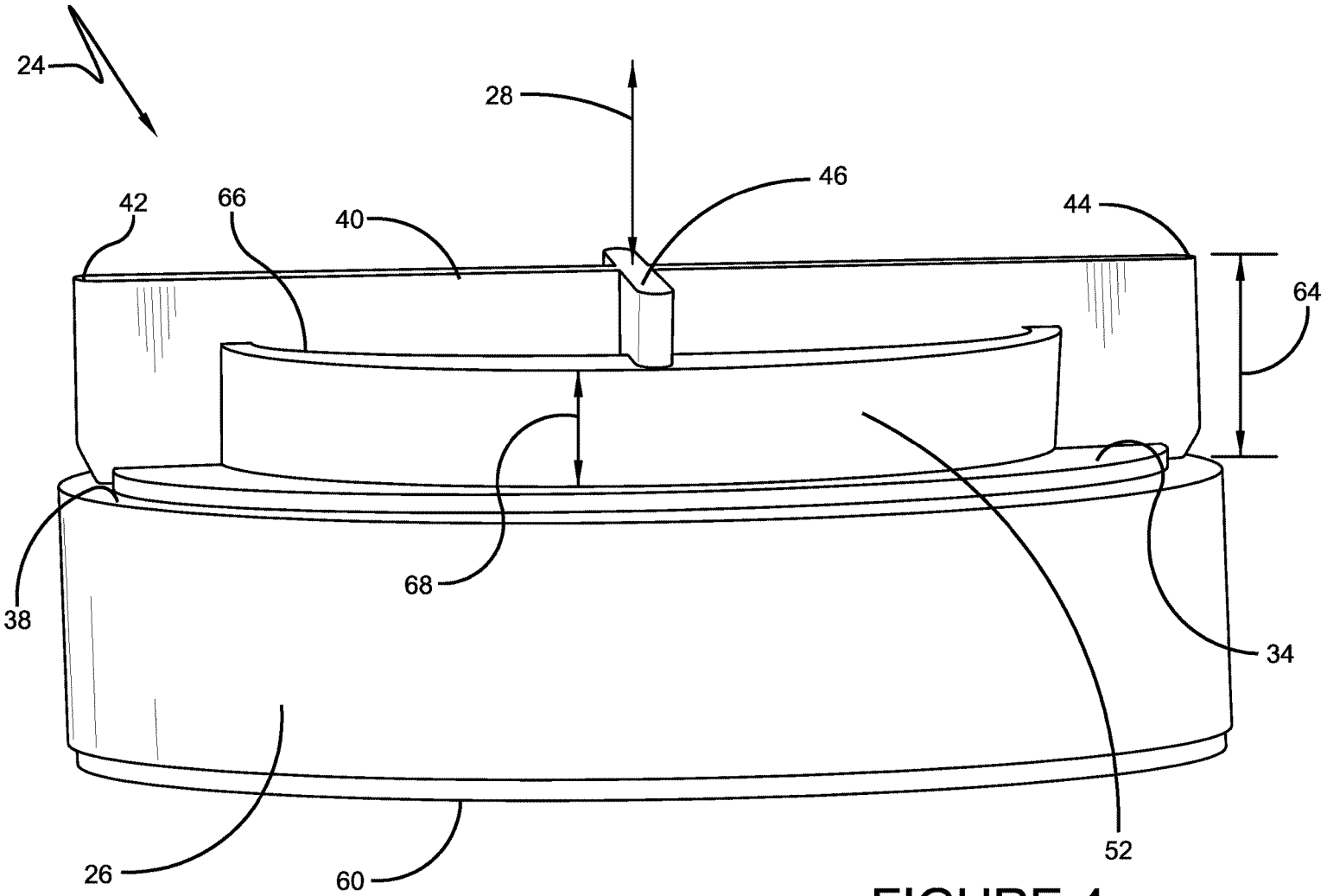
FIG. 4 is a first generally side perspective view of the lantern auxiliary base shown in FIGS. 2-3.
Figure 5:
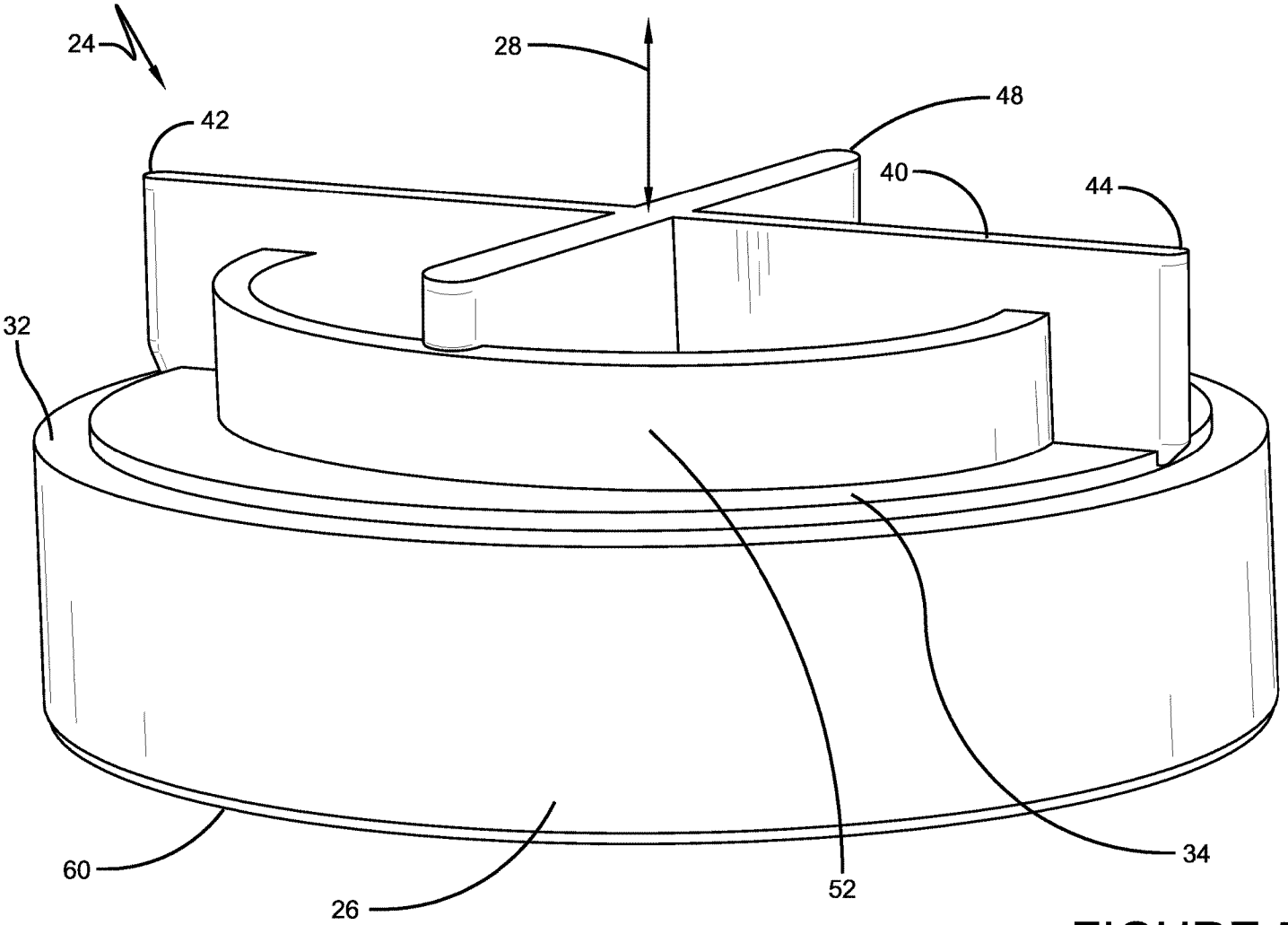
FIG. 5 is a second generally side perspective view of the lantern auxiliary base shown in FIGS. 2-4.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

Figure 6:
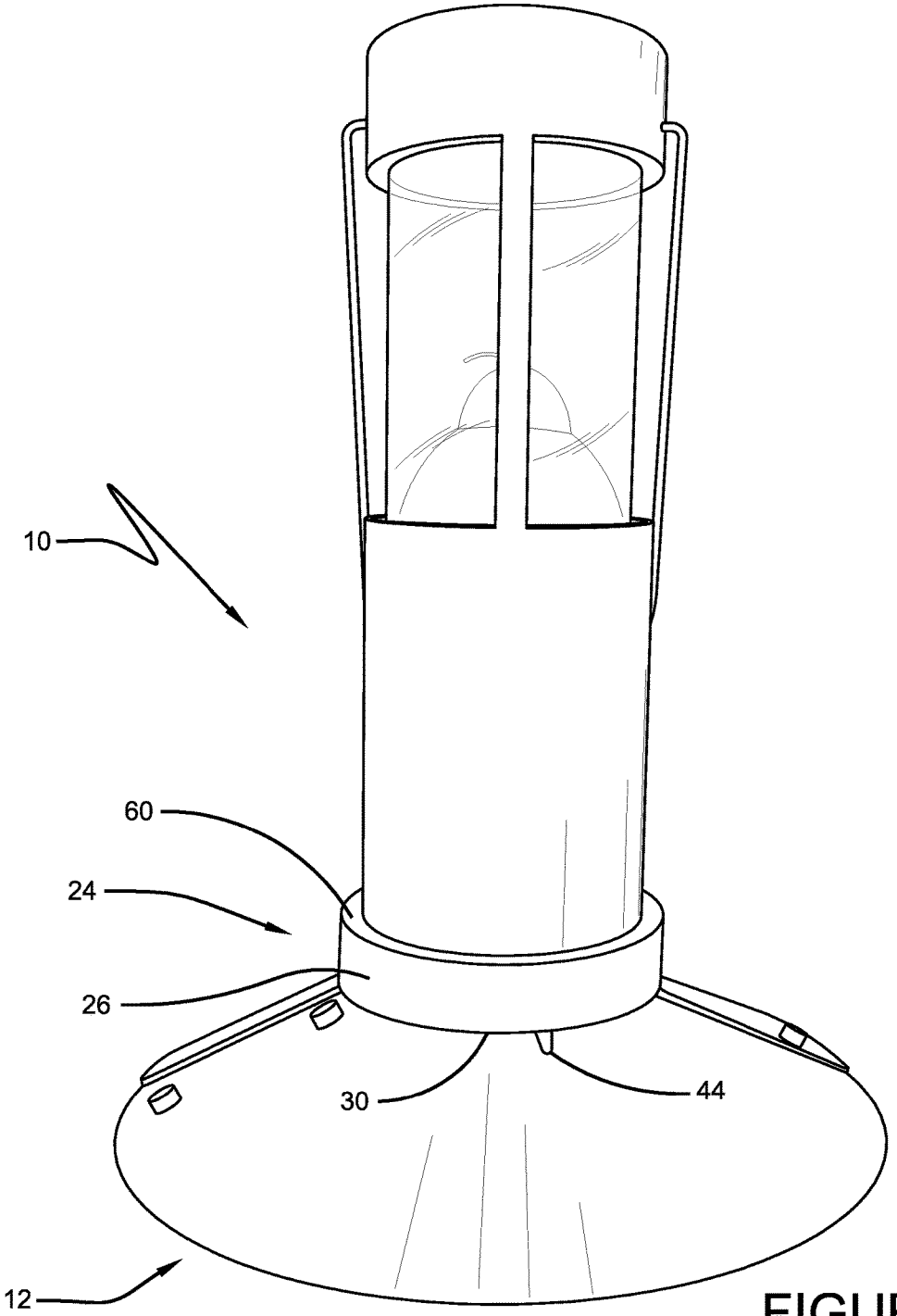
FIG. 6 is an assembly view of a lantern, a reflector, and the lantern auxiliary base shown in FIGS. 2-5.

The present disclosure, as demonstrated by the exemplary embodiment described below, can provide an auxiliary base for a candle lantern to allow the candle lantern to stand more securely in snow or winter conditions. The auxiliary base can also inhibit the melting of snow under the lantern when the lantern is positioned on snowy ground. The auxiliary base can also be used as an adapter for an even more stable base by fitting a reflector to the underside of the lantern through the auxiliary base (as shown in FIG. 6) as a broad base for more stable use in any operating environment.

Figure 7:
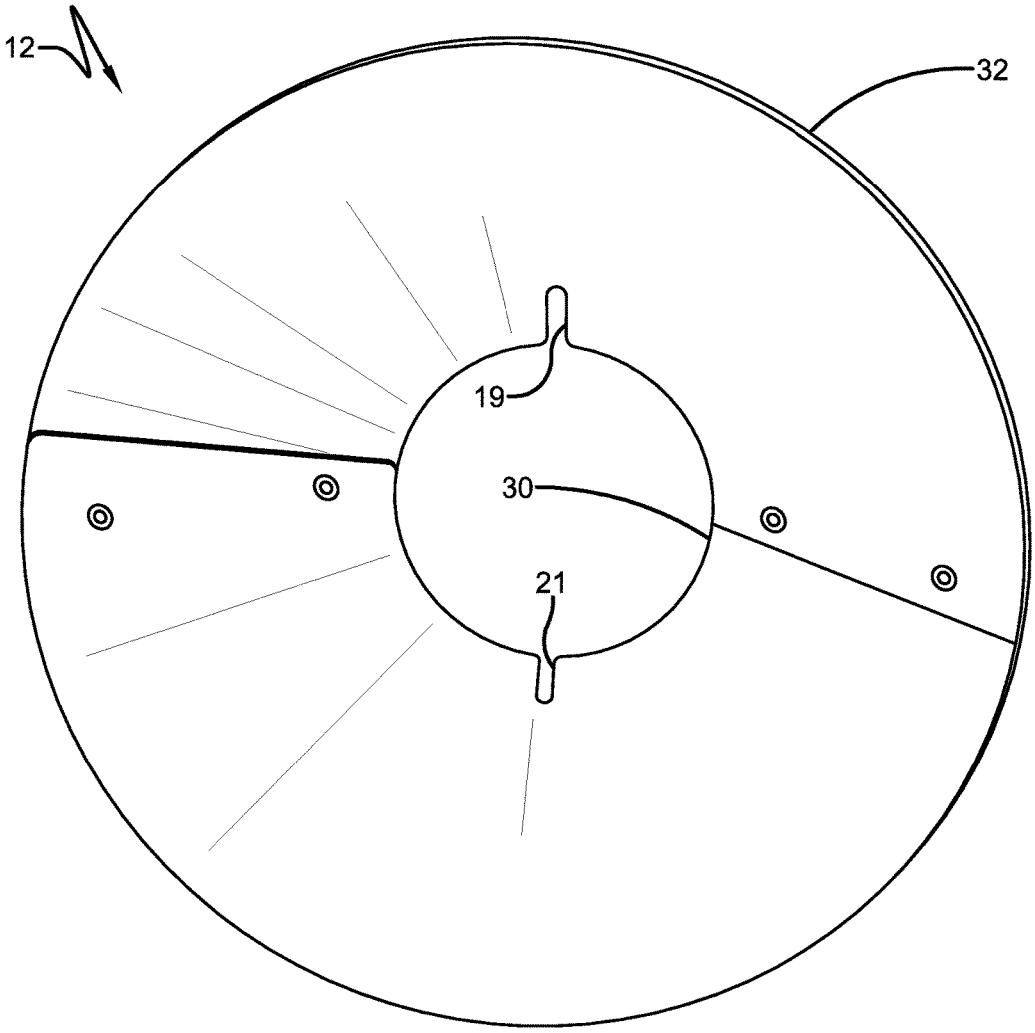
FIG. 7 is a perspective view of from generally a bottom perspective of a shade.

FIG. 1 is a perspective view of a portable lantern 10 and a shade 12 that can be components of a lantern assembly 54 according to an embodiment of the present disclosure. The lantern 10 can extend vertically along a central longitudinal axis 14 between a top 16 and a bottom 18. The shade 12 can be positioned at the top 16. As best shown in FIG. 7, the shade 12 can define a top opening 30 of a first diameter selectively engageable with the top 16 of the lantern 10 and a bottom opening 32 of a second diameter greater than the first diameter. The exemplary shade 12 has a frusto-conical shape. The shade 12 can also include bail handle slots 19, 21 that receive opposite sides of a bail handle for suspending the lantern assembly 54 during use. Opposite sides of a bail handle for suspending the lantern 10 during use are referenced in FIG. 1 at 20 and 22.

FIGS. 2-5 are various perspective views of a lantern auxiliary base 24 according to an exemplary embodiment of the present disclosure. A lantern auxiliary base 24 can include a wall 26, a floor 34, a first cross-beam 40, a second cross-beam 46, and a ring 52. The wall 26 can encircle a vertically-extending longitudinal axis 28. The axes 14 and 28 are collinear when the base 24 and the lantern 10 are engaged with one another and are therefore used interchangeably herein. The wall 26 can extend along the longitudinal axis 14 between a top end 60 and a bottom end 62. The exemplary wall 26 extends 360° about the longitudinal axis 14.

The lantern auxiliary base 24 can also include a floor 34 fixedly engaged with the wall 26 at the bottom end 62. The floor 34 can at least partially close the bottom end 62. The exemplary floor 34 fully closes the bottom end 62. The top end 60 can remain open to receive the lantern 10. The wall 26 and the floor 34 can define a cup-shaped cavity sized to slidably receive the lantern 10. Slidably receive refers to a size, or relative sizes, which permits receipt of the bottom 18 in the cup-shaped cavity but does not permit the bottom 18 to shift laterally relative to the axis 14. The bottom 18 can slide along at least part of the inwardly-facing surface of the wall 26 during insertion in the cup-shaped cavity. The floor 34 can have a top surface 36 facing the top end 60 and a bottom surface 38 opposite to the top surface 36. The lantern 10 can rest on the top surface 36 of the floor 34 when the bottom 18 is received in the cup-shaped cavity. The wall 26 can surround the bottom 18 of the lantern 10.

The lantern auxiliary base 24 can also include a first cross-beam 40 projecting vertically downward along the longitudinal axis 28 away from the bottom surface 38. The first cross-beam 40 can extend a length in the horizontal direction between a first end 42 and a second end 44. The first cross-beam 40 can have a thickness or width sized to correspond to the width of the bail handle slots 19, 21 of the shade 12 such that the first cross-beam 40 can fit into bail handle slots 19, 21 and inhibit relative rotational movement between the lantern auxiliary base 24 and the shade 12 when the cross-beam 40 is positioned in the slots 19, 21. The length of the first cross-beam 40 can correspond to the distance between the closed ends of the bail handle slots 19, 21 of the shade 12 such that the first cross-beam 40 can fit into both bail handle slots and inhibit relative lateral and rotational movement between the lantern auxiliary base 24 and the shade 12 when the cross-beam 40 is positioned in the slots 19, 21.

The lantern auxiliary base 24 can also include a second cross-beam 46 projecting vertically downward along the longitudinal axis 28 away from the bottom surface 38. The second cross-beam 46 can extend a length in the horizontal direction between a first end 48 and a second end 50. The length of the second cross-beam 46 can correspond to the diameter of the top opening 30 of the shade 12 (referenced at 30 in FIG. 4 of the '561 patent) such that the second cross-beam 46 can fit into the opening 30 and inhibit relative lateral movement between the lantern auxiliary base 24 and the shade 12.

The first and second cross-beams 40, 46 can be transverse to one another, such as perpendicular or non-perpendicular. The first and second cross-beams 40, 46 can intersect one another or not. The first and second cross-beams 40, 46 can extend a same distance from the bottom surface 38 along the longitudinal axis 28 or different distances. In the exemplary embodiment, the first and second cross-beams 40, 46 can extend a first distance from the bottom surface 38 along the longitudinal axis 14 referenced at 64 in FIG. 4. Also, in the exemplary embodiment, only one of the first cross-beam 40 and the second cross-beam 46 is sized smaller than the first diameter so that that cross-beam can be received in the top opening 30 of the shade 12.

The first and second cross-beams 40, 46 define respective first and second widths 56, 58 along respective axes extending perpendicular to the longitudinal axis 14. The exemplary first width 56 and the exemplary second width 58 can be different from one another, but could be the same in other embodiments of the present disclosure. The bail handle slots 19, 21 can extend radially outward from the top opening 30. The bail handle slots 19, 21 are sized to slidably receive at least one of the first cross-beam 40 and the second cross-beam 46. The exemplary bail handle slots 19, 21 are sized to slidably receive the ends 42, 44 of first cross-beam 40.

The lantern auxiliary base 24 can also include a ring 52 projecting vertically downward along the longitudinal axis 28 away from the bottom surface 38 to a bottom edge 66. The ring 52 can project away from the bottom surface 38 a second distance 68 from the bottom surface 38 along the longitudinal axis 28 that is less than the first distance (the distance that the cross-beams 40, 46 project downwardly). A diameter of the ring 52 can correspond to the diameter of the top opening 30 of the shade 12 such that the ring 52 can fit into the opening and inhibit relative lateral movement between the lantern auxiliary base 24 and the shade 12. When the lantern 10 is placed on snowy ground, the cross-beams 40, 46 can pass into the snow or deeper into the snow than the ring 52. The arrangement of the cross-beams 40, 46 and ring 52 thus provides enhanced stability in this situation.

In one or more embodiments of the present disclosure, the lantern auxiliary base 24 can be integral with the lantern 10 or selectively attachable to the lantern 10. Selectively attachable refers to an arrangement in which the base 24 remains encircling the bottom 18 when the lantern 10 is suspended, but can be removed by the application of additional force by the user. For example, the base 24 could include a magnet embedded in the base 24 or glued to the base 24 that allows a user to selectively attach the base 24 to the lantern 10. Alternatively, other structures could be utilized to allow the base 24 to be selectively attached to the bottom 18 of the lantern 10 while the lantern is being suspended, such as hook and loop fasteners, annular mating threads on the bottom 18 and the wall 26, or a friction-fit in which the bottom 18 and wall 26 are sized so that the wall 26 tightly fits the bottom 18. An adhesive pad could be positioned in the cup-shaped cavity. Ribs may be added to the inside of the wall 26 or a friction insert on the wall 26 to inhibit separation between the base 24 and the lantern 10.

The components of the exemplary lantern auxiliary base 24 can be formed from any sufficiently rigid material. The wall 26, the floor 34, the first cross-beam 40, and the second cross-beam 46 are integrally-formed with respect to one another in the exemplary embodiment. The components of the exemplary lantern auxiliary base 24 can be formed from plastic. The components of the exemplary lantern auxiliary base 24 can be integrally-formed. "Integrally-formed" refers to the fact that in the exemplary embodiment the components of the exemplary lantern auxiliary base 24 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

Figure 8:
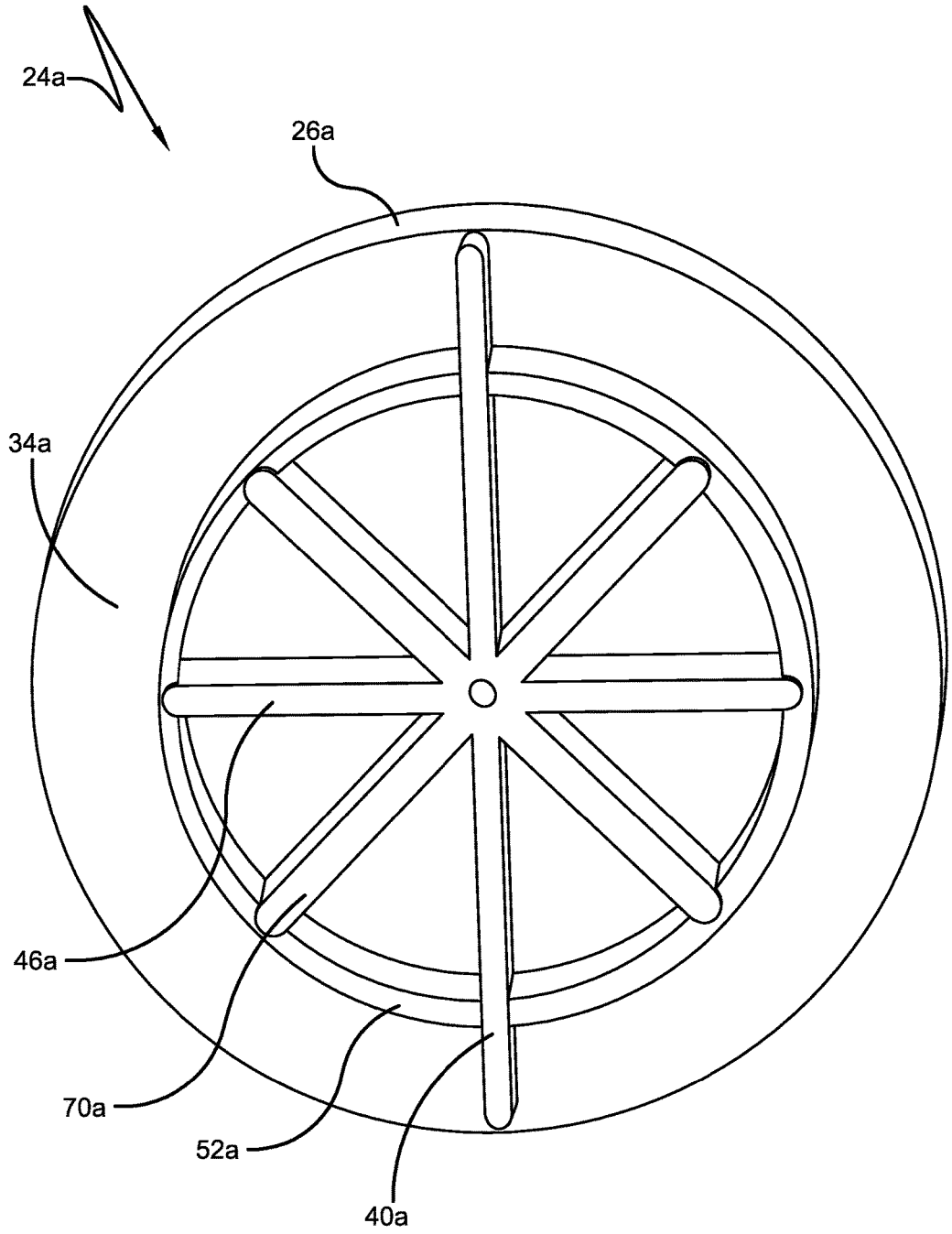
FIG. 8 is a generally bottom-up perspective view of the lantern auxiliary base according to another embodiment of the present disclosure.
Figure 9:
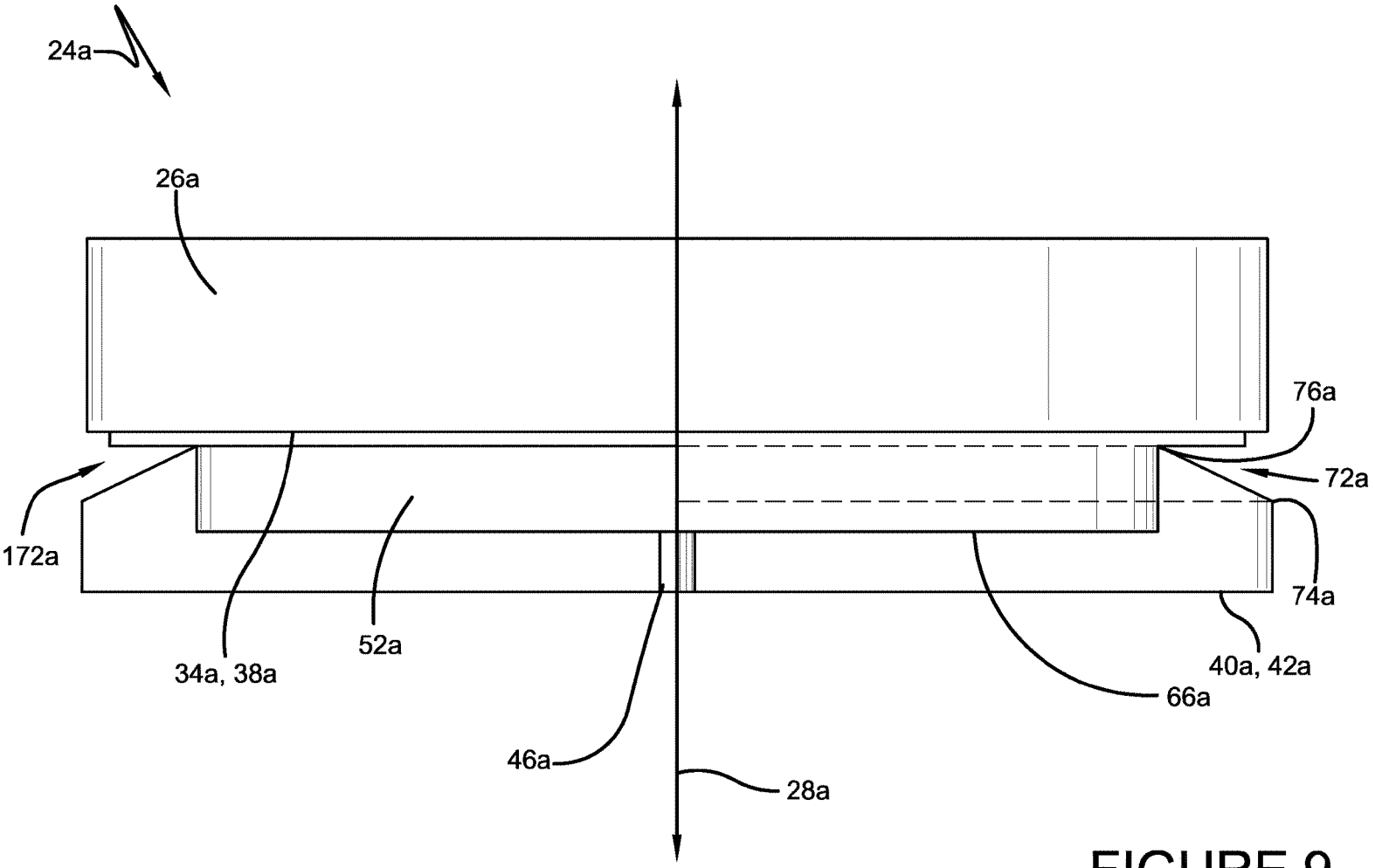
FIG. 9 is a generally side perspective view of the lantern auxiliary base shown in FIG. 8.

FIGS. 8 and 9 show a second embodiment of the present disclosure. A lantern auxiliary base 24*a* can include a wall 26*a*, a floor 34*a*, a first cross-beam 40*a*, a second cross-beam 46*a*, and a ring 52*a*, centered on an axis 28*a*. The lantern auxiliary base 24*a* also includes a third cross-beam 70*a* projecting along the longitudinal axis 28*a* away from the bottom surface 38*a*. The cross-beams 40*a*, 46*a*, 70*a* are transverse to one another.

As best shown in FIG. 9, the lantern auxiliary base 24*a* also includes at least one notch 72*a* defined in one of the first cross-beam 40*a* and the second cross-beam 46*a*. The exemplary notch 72*a* is defined in the first cross-beam 40*a*. The exemplary lantern auxiliary base 24*a* also includes a notch 172*a*. The first and second notches 72*a*, 172*a* are respectively defined at opposite ends 42*a*, 44*a* of the first cross-beam 40*a*. The first and second notches 72*a*, 172*a* are structurally mirrored with respect to one another across the longitudinal axis 28*a*. The notch 72*a* can extend radially inward toward the ring 52*a* from a radially-outer perimeter of the first cross-beam 40*a*. The notch 72*a* is defined along the longitudinal axis 28*a* between a first point and second point. The exemplary first point is referenced at 74*a* and is between the bottom edge 66*a* of the ring 52*a* and the bottom surface 38*a*. The exemplary second point is referenced at 76*a* and is at an intersection of the ring 52*a* and the floor 34*a*.

In one or more embodiments of lantern assembly 54 of the present disclosure, the lantern 10, the shade 12, and the lantern auxiliary base 24 are engageable with respect to one another in a plurality of different configurations for operation in any one of the plurality of different configurations. The plurality of different configurations include a first configuration wherein the bottom 18 of the lantern 10 is positioned in the cup-shaped cavity and the shade 12 is positioned on the top 16 of the lantern 10. This configuration is shown in FIG. 1.

The plurality of different configurations include a second configuration wherein the bottom 18 of the lantern 10 is positioned in the cup-shaped cavity and the shade 12 is spaced from the top 16 of the lantern 10 at the bottom surface 38 of the floor 34 with at least one of the first cross-beam 40 and the second cross-beam 46 positioned in the top opening 30 of the shade 12. This configuration is shown in FIG. 6. FIG. 6 is an assembly view of the lantern 10, the shade 12, and the lantern auxiliary base 24 shown in FIGS. 2-5. The lantern auxiliary base 24 allows the shade 12 to act as a second auxiliary base for the lantern 10. When the shade 12 is not used to support the lantern auxiliary base 24 and the lantern 10, the lantern auxiliary base 24 can be pressed such that the first and second cross-beams 40, 46 are pressed into the ground and/or the ring is pressed into the ground to solidify the support of the lantern 10.

During assembly of the base 24*a* with the shade in the second configuration, the cross-beam 40*a* can be inserted through the slots 19, 21 until the top opening 30 contacts the bottom surface 38*a*. The ends 42*a*, 44*a*, will have passed through the slots 19, 21 and one of the shade 12 and the base 24*a* can then be rotated relative while the top opening 30 is positioned in the notches 72*a*, 172*a* and the ends 42*a*, 44*a* of the cross-beam 40*a* are below the top opening 30 along the axis 14*a*. This process selectively locks the shade 12 and base 24*a* together.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. Further, the "present disclosure" as that term is used in this document is what is claimed in the claims of this document. The right to claim elements and/or subcombinations that are disclosed herein as other present disclosures in other patent documents is hereby unconditionally reserved.

What is claimed is:

1. A lantern auxiliary base comprising:

a wall encircling a vertically-extending longitudinal axis and extending along said longitudinal axis between a top end and a bottom end;

a floor fixedly engaged with said wall at said bottom end and at least partially closing said bottom end, said top end remaining open, said wall and said floor defining a cup-shaped cavity, said floor having a top surface facing said top end and a bottom surface opposite said top surface;

a first cross-beam projecting along said longitudinal axis away from said bottom surface;

a second cross-beam projecting along said longitudinal axis away from said bottom surface, said first and second cross-beams being transverse to one another, wherein at least one of said first and second cross-beams extends a first distance from said bottom surface along said longitudinal axis; one of the cross-beams is longer in length than the other; and a ring projecting vertically downward along said longitudinal axis away from said bottom surface to a bottom edge, said bottom edge a second distance from said bottom surface along said longitudinal axis less than said first distance.

2. The lantern auxiliary base of claim 1 wherein said wall extends 360° about said longitudinal axis.

3. The lantern auxiliary base of claim 1 wherein said wall and said floor are further defined as integrally-formed with respect to one another.

4. The lantern auxiliary base of claim 1 wherein both of said first and second cross-beams extend said first distance from said bottom surface along said longitudinal axis.

5. The lantern auxiliary base of claim 1 wherein said floor is further defined as fully closing said bottom end.

6. The lantern auxiliary base of claim 1 wherein said first and second cross-beams each define respective first and second widths along respective axes extending perpendicular to said longitudinal axis, said first width and said second width different from one another.

7. The lantern auxiliary base of claim 1 wherein said first and second cross-beams are further defined as intersecting one another.

8. The lantern auxiliary base of claim 1 wherein said wall, said floor, said first cross-beam, and said second cross-beam are further defined as integrally-formed with respect to one another.

9. The lantern auxiliary base of claim 1 further comprising:

at least one notch defined in one of said first cross-beam and said second cross-beam.

10. The lantern auxiliary base of claim 1 further comprising:

a third cross-beam projecting along said longitudinal axis away from said bottom surface, said first, second and third cross-beams being transverse to one another.

11. The lantern auxiliary base of claim 9 wherein said at least one notch is further defined as:

first and second notches respectively defined at opposite ends of said one of said first cross-beam and said second cross-beam, said first and second notches structurally mirrored with respect to one another across said longitudinal axis.

12. The lantern auxiliary base of claim 9 wherein said at least one notch if further defined as extending radially inward toward said ring from a radially-outer perimeter of said one of said first cross-beam and said second cross-beam.

13. The lantern auxiliary base of claim 9 wherein said at least one notch is defined along said longitudinal axis between a first point and second point, wherein said first point is between said bottom edge of said ring and said bottom surface.

14. The lantern auxiliary base of claim 9 wherein said at least one notch is further defined as formed in only one of one of said first cross-beam and said second cross-beam.

15. The lantern auxiliary base of claim 13 wherein said second point is at an intersection of said ring and said floor.

16. A lantern assembly comprising:

a lantern extending along a longitudinal axis between a top and a bottom;

a shade defining a top opening of a first diameter selectively engageable with said top of said lantern and a bottom opening of a second diameter greater than said first diameter; and a lantern auxiliary base including:

a wall encircling a vertically-extending longitudinal axis and extending along said longitudinal axis between a top end and a bottom end;

a floor fixedly engaged with said wall at said bottom end and at least partially closing said bottom end, said top end remaining open, said wall and said floor defining a cup-shaped cavity sized to slidably receive said bottom of said lantern, said floor having a top surface facing said top end and a bottom surface opposite said top surface;

a first cross-beam projecting along said longitudinal axis away from said bottom surface;

a second cross-beam projecting along said longitudinal axis away from said bottom surface, said first and second cross-beams being transverse to one another, wherein at least one of said first and second cross-beams extends a first distance from said bottom surface along said longitudinal axis, and wherein only one of said first cross-beam and said second cross-beam is sized smaller than said first diameter to be received in said top opening of said shade; one of the cross-beams is longer in length than the other; and a ring projecting vertically downward along said longitudinal axis away from said bottom surface, said ring extending a second distance from said bottom surface along said longitudinal axis less than said first distance, said ring sized less than said first diameter.

17. The lantern assembly of claim 16 wherein said shade further comprises:

bail handle slots extending radially outward from said top opening.

18. The lantern assembly of claim 17 wherein said bail handle slots are sized to slidably receive at least one of said first cross-beam and said second cross-beam.

19. The lantern assembly of claim 18 wherein said lantern, said shade, and said lantern auxiliary base are engageable with respect to one another in a plurality of different configurations for operation in any one of said plurality of different configurations, said plurality of different configurations including:

a first configuration wherein said bottom of said lantern is positioned in said cup-shaped cavity and said shade is positioned on said top of said lantern; and a second configuration wherein said bottom of said lantern is positioned in said cup-shaped cavity and said shade is spaced from said top of said lantern at said bottom surface of said floor with at least one of said first cross-beam and said second cross-beam positioned in said top opening of said shade.

20. The lantern assembly of claim 19 further comprising:

at least one notch defined in one of said first cross-beam and said second cross-beam, wherein said top opening of said shade is positioned in said at least one notch when said lantern, said shade, and said lantern auxiliary base are in said second configuration.

* * * * *